US005343930A

United States Patent [19]

Yagi et al.

[11] Patent Number: 5,343,930

[45] Date of Patent: Sep. 6, 1994

[54] CENTRIFUGAL CASTING SYSTEM HAVING A CARRIER OF ELONGATED MATERIALS

[75] Inventors: Yutaka Yagi; Keizo Ishijima, both of Tokai, Japan

[73] Assignee: Daido Tokushuko Kabushiki Kaisha, Japan

[21] Appl. No.: 35,642

[22] Filed: Mar. 23, 1993

[30] Foreign Application Priority Data

Mar. 30, 1992 [JP] Japan ..... 4-074562

[51] Int. Cl.[5] ..... B22D 13/10

[52] U.S. Cl. ..... 164/295; 164/114

[58] Field of Search ..... 164/295, 114

[56] References Cited

FOREIGN PATENT DOCUMENTS 565040 10/1958 Canada ..... 164/295

632104 11/1949 United Kingdom ..... 164/295

*Primary Examiner*—Kuang Y. Lin

*Attorney, Agent, or Firm*—Davis, Bujold & Streck

[57] ABSTRACT

A centrifugal casting carrier system comprising a fixed roller conveyor, a pivotal roller conveyor provided at an adjustable angle to the fixed roller conveyor to form a V-shaped path and thrust arms provided at an approximately right angle to the pivotal roller conveyor for thrusting castings out of the V-shaped path when opened. In operation, a casting from one of the casting molds is drawn onto the V-shaped path. When the pivotal roller conveyor is lowered to open the V-shape path, the thrust arms are raised thrusting the casting out of the V-shaped path onto a stocker. By repeating the operation, multiple castings can be continually drawn and carried away to the stocker without delay.

8 Claims, 7 Drawing Sheets

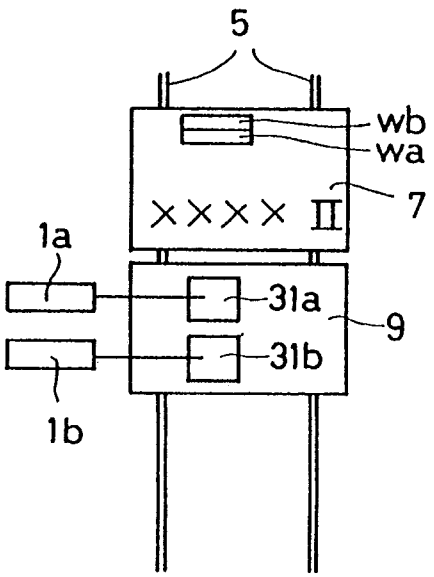
FIG. 6C
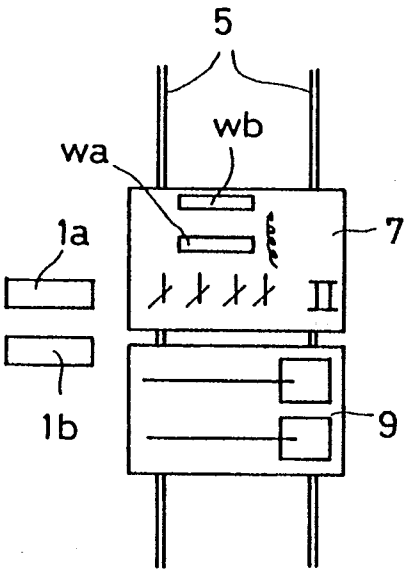
FIG. 6B
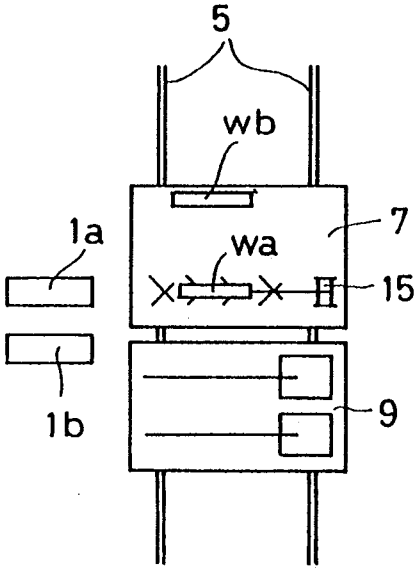
FIG. 6A
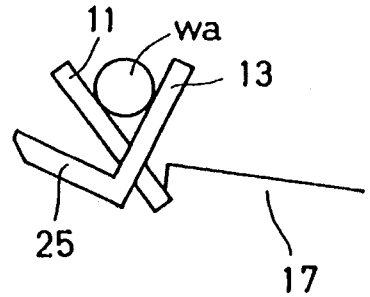
FIG. 6E
FIG. 6D

CENTRIFUGAL CASTING SYSTEM HAVING A CARRIER OF ELONGATED MATERIALS

BACKGROUND OF THE INVENTION

This invention relates to a conveyor for carrying out elongated castings such as pipes, bars and lines from casting molds and also to a centrifugal casting system that incorporates such conveyer therein.

A typical elongated casting conveyor is disclosed in Japan Published Unexamined Patent Application No. 63-16846. FIG. 7 shows a prior-art elongated casting carrier for drawing and conveying castings from a casting mold. This conventional casting carrier 105 includes a drawing unit 113, which in turn comprises a winch 111, a wire 107 and an oval engaging board 109 attached to a free end of the wire 107. When the engaging board 109 is placed in a casting 103, the oval surface of the engaging board 109 opposite the wire 107 inserted in the casting 103 first. Also, the engaging board 109 is inserted in the casting 103 while maintaining the major axis of the engaging board 109 at an oblique angle to the axis of the casting 103. Portions of the edges of the engaging board 109 are then engaged with the inner surface of the casting 103. At this step, the wire 107 is wound up by the winch 111 to draw the casting 103 from a casting mold 101 onto a level roller conveyor 115. Then, the casting 103 is axially carried off by the roller conveyor 115. This conventional casting carrier 105 is also provided with a conveyor height controller (not shown) for controlling the height of the roller conveyor 115.

This type of casting carrier has several disadvantages. For instance, continuous casting without interruption is not possible if this type of casting carrier is used in combination with a casting system having a multiple centrifugal casting molds. The process must be interrupted because an operator has to lift a freshly drawn casting from the conveyor to a stocker before another casting can be drawn from the casting mold, thus causing an interruption of the operation.

Also, a casting which has just been drawn from a mold tends to be too hot to handle safely, and has to be allowed to cool down before an operator can sling the casting to lift it with a crane. This again causes a considerable delay in the operation.

Moreover, when the engaging board 109 is engaged with the inner surface of the casting 103, the right-angled edges of the engaging board 109 are pressed hard at the inner surface, which tends to damage the engaging portion of the inner surface.

SUMMARY OF THE INVENTION

An object of the invention is to provide an elongated material carrier that enables elongated materials to be carried away smoothly and continuously by moving the elongated materials laterally relative to their longitudinal axes, hence dispensing with the shifting operation that requires a crane.

Another object of the invention is to provide a centrifugal casting system that incorporates such an elongated material carrier.

To attain these and other objects, the present invention provides an elongated material carrier comprising a fixed roller conveyor fixed at a predetermined oblique angle. A pivotal roller conveyor is provided that is capable of pivoting between a first position and a second position to form a V-shape path along with the fixed roller conveyor at the first position and to open the V-shape path by pivoting downward to the second position. A longitudinal transfer means is provided for transferring elongated materials from the V-shape path in the longitudinal direction to a lateral conveying lane for conveying elongated materials in the direction lateral to the V-shape path. A stock means is provided at the far end of the lateral conveying lane, for stocking elongated materials. Furthermore, a pivoting means for pivoting the pivotal roller conveyor between the first and second positions is provided.

According to the elongated material carrier of the present invention, after the longitudinal transfer means transfers an elongated material to a predetermined position through the V-shape path formed by the fixed roller conveyor and the pivotal roller conveyor, the pivoting means pivots and lowers the pivotal roller conveyor to open the V-shaped path. This will cause the elongated material to roll onto the lateral conveying lane to the stock means provided beyond the lateral conveying lane. When the pivotal roller conveyor is raised by the pivoting means, another elongated material can then be carried away.

In the elongated material carrier, the pivoting means further comprises a thrust means for thrusting out elongated materials on the V-shape path by laterally moving between rollers of the fixed roller conveyor when the pivoting means opens the V-shape path by pivoting the pivotal roller conveyor to the second position.

According to the elongated material carrier of the present invention, when the pivotal roller conveyor is lowered by the pivoting means, the thrust means is also driven by the pivoting means to thrust an elongated material onto the lateral conveying lane. In this way, the elongated material is surely passed to the lateral conveying lane.

Moreover, the thrust means may be thrust arms which pivot together with the pivotal roller conveyor, whereby said thrust arms are raised by the pivoting means to thrust an elongated material when the pivotal roller conveyor is lowered. Such thrust arms thrust elongated materials in a timely and smooth manner.

The above elongated material carrier may further comprise a lateral moving unit for laterally moving at least the fixed roller conveyor and the pivotal roller conveyor. Such an elongated material carrier can be positioned to a plurality of elongated material manufacturing units so that elongated materials are continuously and smoothly carried away.

A centrifugal casting system according to the present invention incorporates the elongated material carrier as above. Such a centrifugal casting system comprises a centrifugal casting unit having no less than two casting molds provided side by side and a casting carrier provided in a position to draw castings from the centrifugal casting unit.

The centrifugal casting system comprise a mold lubricant applicator provided side by side with said casting carrier and an applicator moving means for moving the mold lubricant applicator in the direction relatively lateral to the centrifugal casting unit. The mold lubricant applicator includes a mold lubricant tank and at least one means for discharging mold lubricant. The mold lubricant tank and the means for discharging mold lubricant are capable of moving in the axial direction of the centrifugal casting unit.

In the operation of the above centrifugal casting system, upon drawing a casting out of a casting mold, mold lubricant can be immediately applied to the inner surface of the casting mold prior to casting. The carrier moving means moves the casting carrier in the relatively lateral direction while the applicator moving means moves the mold lubricant applicator in the same manner. Thus, when one of the casting carrier and the mold lubricant applicator needs to be positioned in front of a casting mold, one moves out of the way of the other. This realizes continuous application of mold lubricant application and drawing/moving of a casting without disruptions.

The mold lubricant applicator may be connected to the casting carrier so that the mold lubricant applicator and the casting carrier move together in the lateral direction. In this way, when the casting carrier moves away from a casting mold, the mold lubricant applicator is automatically positioned in front of the casting mold, hence more efficiently carrying out application of mold lubricant and drawing/moving of a casting.

Also in the above centrifugal casting system of the present invention, the drawing means may comprises an oval board whose major axis is longer than the inner diameter of a casting. A wire is connected to the oval board at a point close to one end of the major axis and to a winch for winding up the wire.

In operation, the oval board is inserted in the casting with the end connected to the wire being inserted first and placed on the inner surface of the casting on its periphery. Then, the winch is driven to wind up the wire, hence raising the oval board until the periphery thereof is engaged with the upper inner surface of the casting. Since the round periphery of the oval board is engaged with the inner surface of the casting, the oval board does not cause damage to the engaged portion of the inner surface.

BRIEF EXPLANATION OF THE ATTACHED DRAWINGS

FIGS. 6A to 6C are illustrations schematically showing the remaining casting of FIGS. 5A to 5C being drawn and carried away and FIG. 6D is a partial diagrammatic side elevational view of FIG. 6A and FIG. 6E is a partial diagrammatic side elevational view of FIG. 6B.

DETAILED DESCRIPTION OF THE PREFERRED EMBODIMENT

A preferred embodiment will be hereinafter explained referring to the attached drawings.

Figure 1:
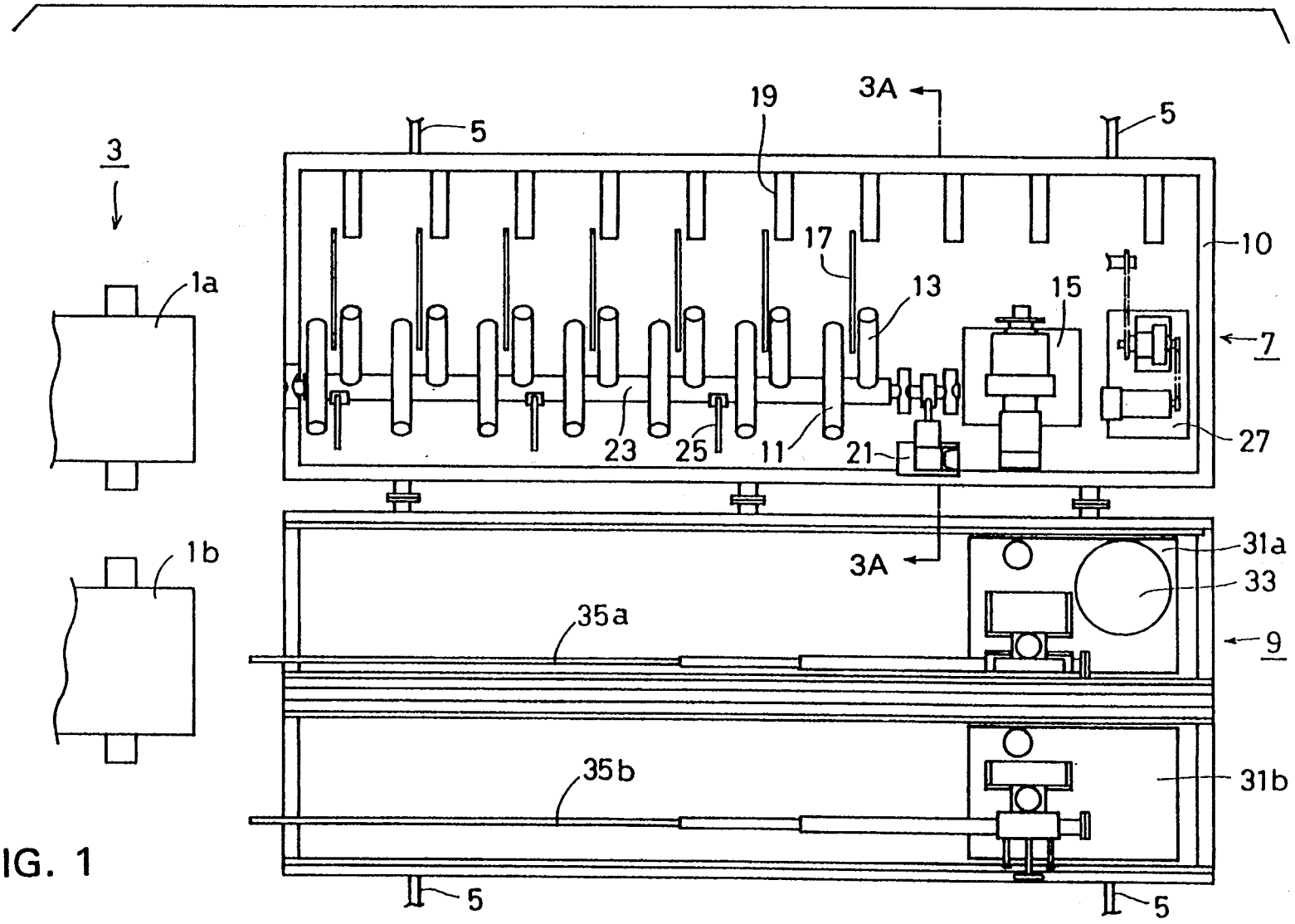
FIG. 1 is a plan view of a centrifugal casting system of an embodiment.

Shown in FIG. 1 is a centrifugal casting system of the embodiment that comprises a centrifugal casting unit 3, a casting carrier 7 and a mold lubricant applicator 9. The centrifugal casting unit 3 further comprises a pair of casting molds 1*a* and 1*b*. The-casting carrier 7 and the mold lubricant applicator 9 are located adjacent to the casting unit 3 and are arranged parallel to the direction in which castings are drawn from the casting molds 1*a* and 1*b*. The casting carrier 7 and the lubricant applicator 9 can move laterally across the casting-drawing direction (hereinafter drawing direction) via rails 5.

Figure 2:
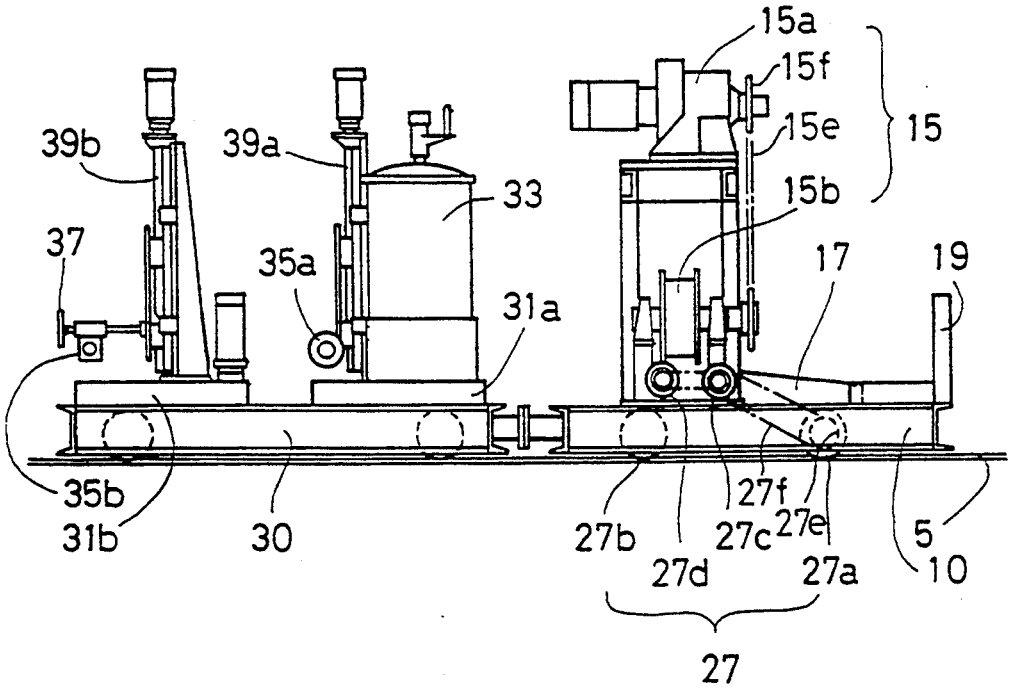
FIG. 2 is a right side elevation view of the centrifugal casting system of the embodiment.

As shown in FIGS. 1 to 3, the casting carrier 7 comprises a steel frame 10, on which the other elements are mounted. A fixed roller conveyor 11 is provided along the drawing direction and is tilted sideways at a predetermined oblique angle to the level surface of the steel frame 10 (see FIGS. 1 and 3). A pivotal roller conveyor 13 is provided on a rotatable shaft 23 along the drawing direction, forming a V-shape path together with the fixed roller conveyor 11. The pivotal roller conveyor 13 pivots on the rotatable shaft 23 for opening the V-shape path. A drawing unit 15 is provided for drawing castings through the V-shape path. Lateral ramps 17 are provided on the side of the V-shaped path to which the pivotal roller conveyor 13 pivots laterally moving the castings to that side (see FIGS. 1 and 2). A stocker 19 is provided at the far end of the lateral ramps 17. A pivotor 21 rotates the shaft 23 for raising and lowering the pivotal roller conveyor 13 by pivoting thereof. Thrust arms 25 are provided on the rotatable shaft 23 at an approximately right angle to the pivotal roller conveyor 13 to thrust the castings down ramp 17 onto the stocker 19. A lateral moving unit 27 for laterally moving the frame 10 along the rails 5 is also provided.

Figure 3A:
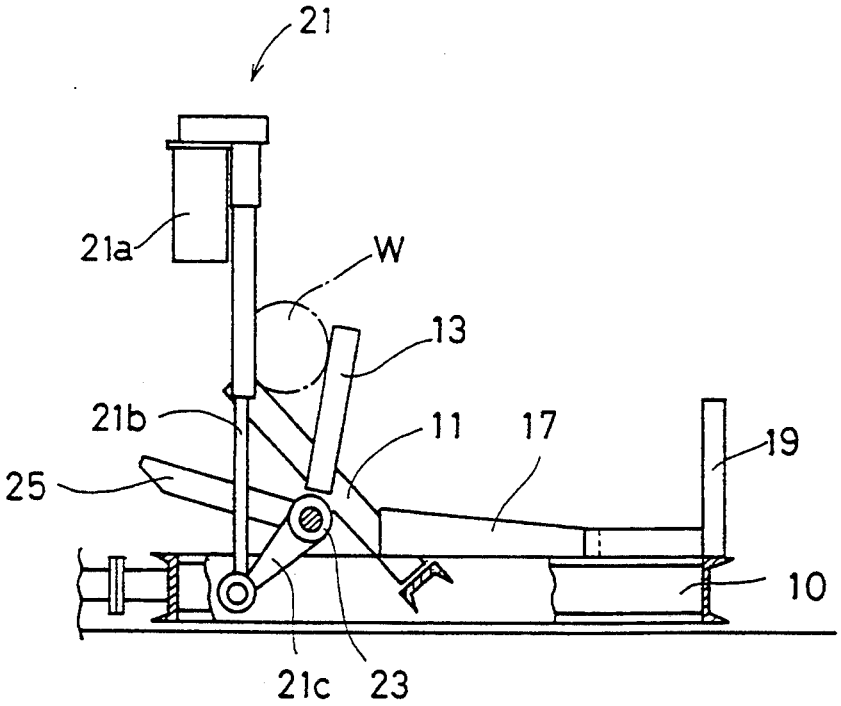
FIG. 3A is diagrammatic cross sectional view of the centrifugal casting system take along section line 3A—3A of FIG. 1
Figure 3B:
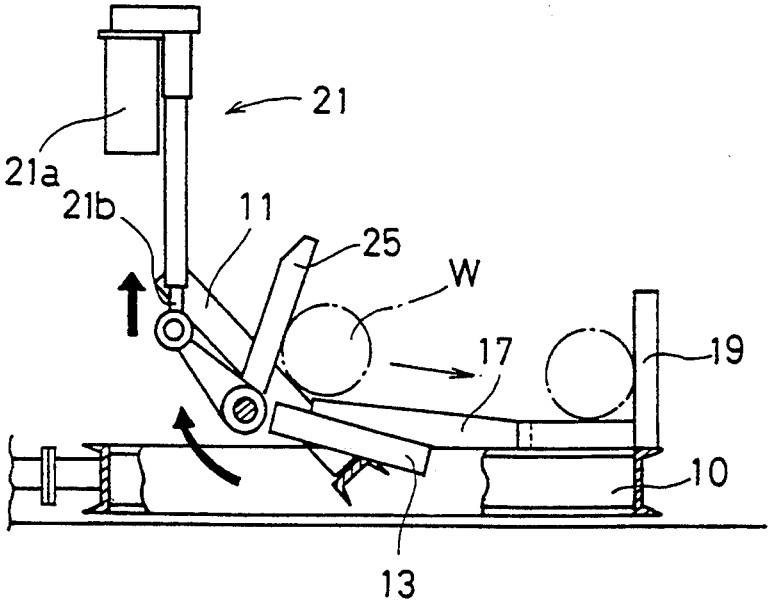
FIG. 3B is a similar diagrammatic cross sectional view, to that shown in FIG. 3A, showing the centrifugal casting system in a different operational position.

As shown in FIGS. 3A and 3B, the pivotor 21 includes a power cylinder 21*a* held at a predetermined height above the frame 10, a rod 21*b* to be extended and retracted by the power cylinder 21*a*, and a lever 21*c* connected to the rod 21*b* and the rotatable shaft 23 on the respective ends. The pivotor 21 pivots the thrust arms 25 and the pivotal roller conveyer 13 by the rotatable shaft 23.

As shown in FIG. 3A, the pivotor 21 forms the V-shape path by extending the rod 21*b* to raise the pivotal roller conveyor 13 and lower the thrust arms 25. The pivotor 21 also opens the V-shape path by retracting the rod 21*b* to lower the pivotal roller conveyor 13 and raise the thrust arms 25 as shown in FIG. 3B. This causes the thrust arms 25 to thrust casting W in the V-shape path onto the lateral ramps 17.

In this way, the retraction of the rod 21*b* causes the well-coordinated action of the V-shaped path and the thrust arms 25 to roll the casting W smoothly down on the lateral ramps 17 to the stocker 19 so that casting w does not stop at the foot of the fixed roller conveyor 11. It is thus possible to proceed to draw another casting from the other casting mold without delay upon simply extending the rod 21*b* to form the V-shape path.

It should be noted that the thrust arms 25 can be dispensed with if the casting W is allowed to roll down onto the lateral ramps 17 automatically. For instance, if the lateral ramps 17 can be located lower and the pivotal roller conveyor 13 can pivot by a larger degree than in the present embodiment, the thrust arms 25 will not be necessary.

The drawing unit 15 is explained hereunder referring to FIGS. 2 and 4A–4D.

The drawing unit 15 includes a winch 15*a* having a speed reducer (not shown). A wire drum 15*b* is connected to and engages with the winch 15*a* via a chain sprocket and a chain. A wire 15*c* is wound around the wire drum 15*b*, a linking member 15*d* is attached to an end of the wire 15*c*, and an oval board 15*e* is rotatably attached to the linking member 15*d*. As shown in FIGS. 4A–4D, the linking member is connected to the oval board 15*e* at a point close to an end of the major axis of the oval board 15*e*.

Figure 4A:
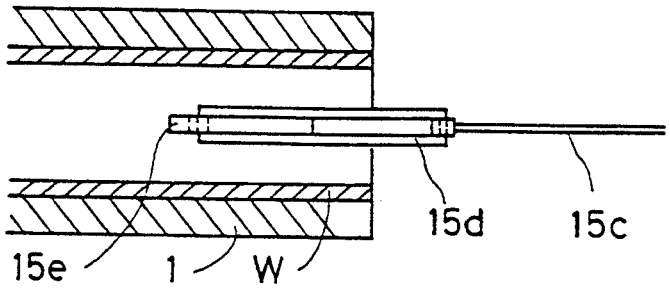
FIG. 4A is a partial top cross-sectional view also depicting the casting drawing operation and FIGS. 4B–4D are partial side cross-sectional views depicting the casting drawing operation.
Figure 4B:
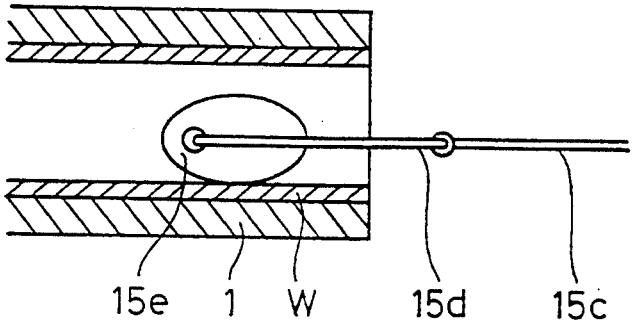
Figure 4C:
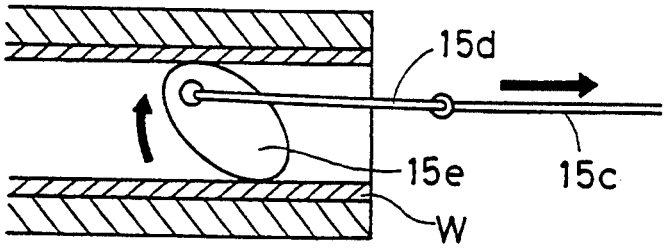
Figure 4D:
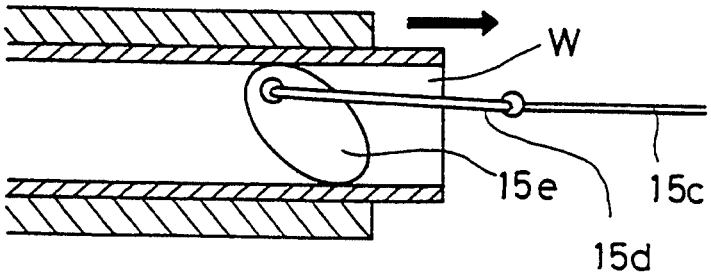

First, the wire 15*c* along with the oval board 15*e* is drawn out from the wire drum 15*b* and inserted into a manufactured casting W. At this step, the oval board must be inserted into the casting W with the end linked to the wire 15*c* being inserted first as shown in FIGS. 4A and 4B. Second, as shown in FIG. 4C, the winch 15*a* is driven to wind up the wire 15*c* on the wire drum 15*b* to create a force couple to raise or rotate the oval board 15*e*, hence engaging the oval board 15*e* with the inner surface of the casting W. Third, the casting W is drawn by further winding the wire 15*c* as shown in FIG. 4D. FIG. 4A is a top partially sectional horizontal view depicting the drawing operation while FIGS. 4B–4D are partially sectional front views depicting the drawing operation.

A lateral moving unit 27 is explained below with reference to FIGS. 1 and 2 which comprises a pair of wheeled axles 27*a* and 27*b* provided at right angles to the rails 5. A speed reducer 27*c* is connected to and engages the axle 27*a* via a sprocket and chain, and a motor 27*d* for driving the speed reducer 27*c*. As will be explained below, the frame 10 of the casting carrier 7 is connected to a frame 30 of the mold lubricant applicator 9. Thus, the lateral moving unit 27 also moves the mold lubricant applicator 9 laterally on the rails 5.

The mold lubricant applicator 9 includes tables 31*a* and 31*b* longitudinally movably provided on the frame 30, a mold lubricant tank 33 mounted on the table 31*a*, discharge pipes 35*a* and 35*b* mounted on the tables 31*a* and 31*b*, respectively, and other members. Furthermore, a hose (not shown) is provided to supply mold lubricant to the table 31*b*. To apply mold lubricant, nozzles (not shown) are attached to the free ends of the discharge pipes 35*a* and 35*b*. Then, the tables 31*a* and 31*b* are moved forward to insert the nozzles into the inside of the casting molds 1*a* and 1*b* to apply mold lubricant.

The discharge pipe 35*b* is provided with a lateral location wheel 37 for adjusting the lateral location of the pipe 35*b*. Moreover, the height of the pipes 35*a* and 35*b* can be adjusted by vertically moving along pillars 39*a* and 39*b*, respectively.

Constructed as described above, the mold lubricant applicator 9 can apply mold lubricant to the two casting molds 1*a* and 1*b* simultaneously.

As explained above in connection with the lateral moving unit 27, the mold lubricant applicator 9 moves laterally together with the casting carrier 7 since the frame 30 is connected with the frame 10.

The operation of the centrifugal casting system of the embodiment will be explained hereinafter referring to FIGS. 5A–5E and 6A–6E.

Figure 5A:
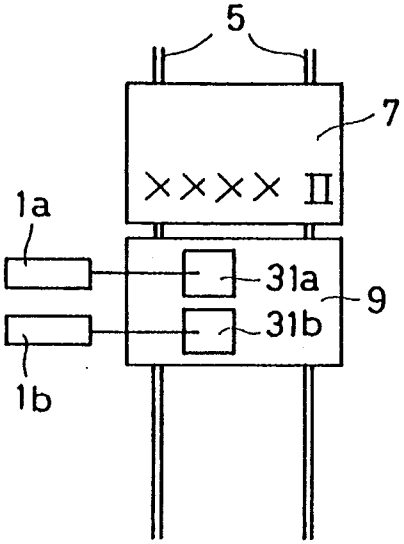
FIGS. 5A to 5C are illustrations schematically showing the operation of the centrifugal casting system of the embodiment where casting molds are lubricated and one of two castings is drawn and carried away and FIG. 5D is a partial diagrammatic side elevational view of FIG. 5B

First, the lateral moving unit 27 is driven to bring the tables 31*a* and 31*b* of the mold lubricant applicator 9 right in front of the respective casting molds 1*a* and 1*b*. Second, both tables 31*a* and 31*a* are moved forward to apply mold lubricant to the inner surface of the casting mold 1*a* and 1*b* simultaneously as shown in FIG. 5A. Then, upon completing the lubricant application, molten metal is poured into the casting molds 1*a* and 1*b* while the casting mold unit 3 is rotating the two casting molds 1*a* and 1*b*.

Now, the lateral moving unit 27 is operated to position the wire drum 15*b* of the casting carrier 7 in front of the casting mold 1*b*. At this step, the mold lubricant 9 moves along with the casting carrier 7 and does not get in the way.

Figure 5B:
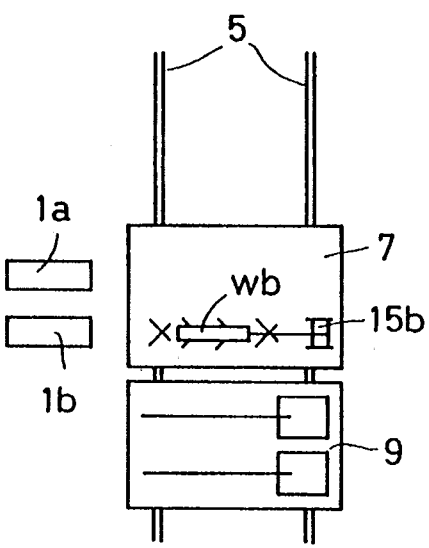
Figure 5C:
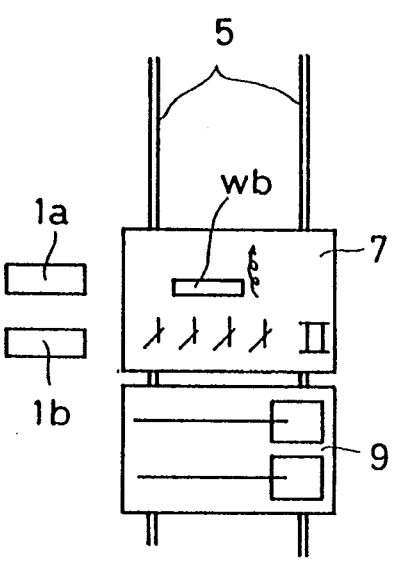
Figure 5D:
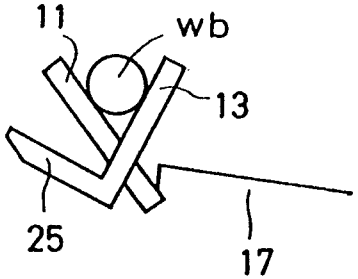
Figure 5E:
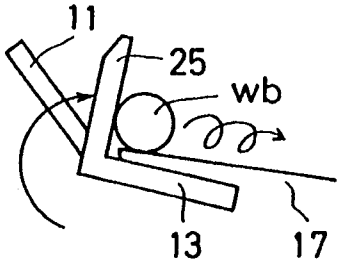
FIG. 5E is a partial diagrammatic side elevational view of FIG. 5C.
Figure 7:
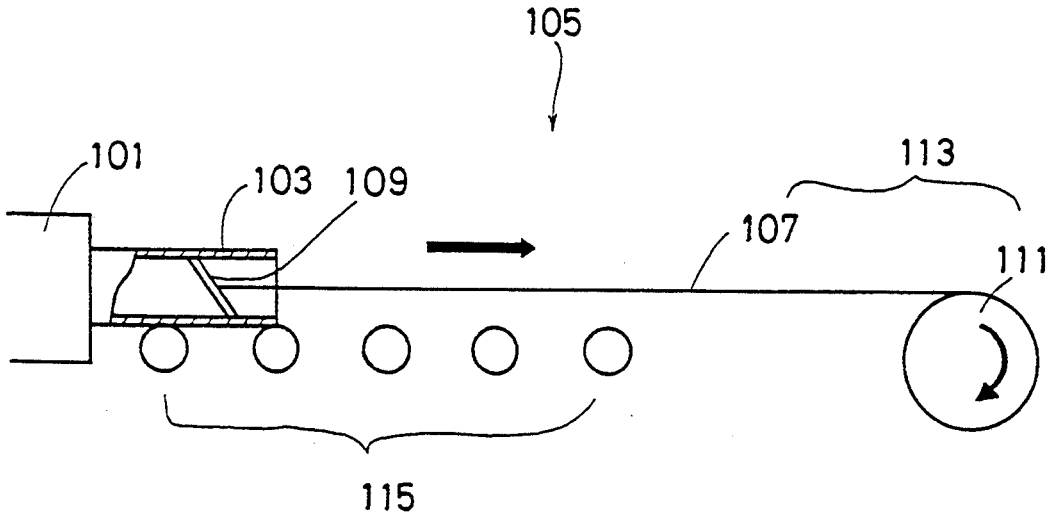
FIG. 7 PRIOR ART
FIG. 7 is an elevation view of a prior-art casting carrier.

Then, as shown in FIGS. 5B and 5D, a casting Wb is drawn from the casting mold 1*b* onto the V-shaped path through the steps explained in connection with FIGS. 4A–4D. The pivotor 21 is then driven to lower the pivotal roller conveyor 13 and to raise the thrust arms 25, thus thrusting the casting Wb down on the lateral ramps 17 to the stocker 19 as shown in FIGS. 5C and 5E.

Upon completing the above steps, the lateral moving unit 27 is again operated to position the wire drum 15*b* of the casting carrier 7 in front of the other casting mold 1*a* as shown in FIG. 6A.

Then, as shown in FIGS. 6A and 6D, a casting Wa is drawn through the steps explained in connection with FIGS. 4A–4D. The pivotor 21 is driven to thrust the casting Wa down on the lateral ramps 17 to the stocker 19 as shown in FIGS. 6B and 6E. In this way, the two castings Wa and Wb are continuously drawn from the respective casting molds 1*a* and 1*b* and stored in the stocker 19.

Having completed this cycle of manufacturing and shifting two castings, the two tables 31*a* and 31*b* of the mold lubricant applicator 9 are moved to a position in front of the respective casting molds is and 1*b*. The inner surfaces of the casting molds 1*a* and 1*b* are cleaned before the tables 31*a* and 31*b* are moved forward to apply mold lubricant simultaneously as shown in FIG. 6C. The whole process is repeated as described above.

As can be clearly understood from the above explanation, according to the present embodiment, the casting carrier 7 can smoothly carry castings to the stocker 19 without leaving the castings in the V-shape path. According to the prior art system, on the other hand, each casting drawn from a casting mold has to be manually handled and slung by a crane to be shifted to a stocker. This is a time-consuming operation where it is difficult to continually draw a plurality of castings from casting molds without interruptions. Such problems inherent to the prior art system have been solved by the embodiment.

Furthermore, since the pivotal roller conveyor 13 lowers in coordination with a rise of the thrust arms 25 to dump a casting smoothly down on the lateral ramps 17, the casting does not stop at the foot of the fixed roller conveyor 11 where the fixed roller conveyor 11 is connected to the lateral ramps 17 without reaching the stocker 19. This also greatly contributes to more efficient production due to reduced manufacturing steps and time.

The centrifugal casting system of the embodiment is provided with the mold lubricant applicator 9 that moves in parallel with the casting carrier 7, which enables immediate preparation of the next casting once two castings have been drawn. During the manufacturing steps, when one of the casting carrier 7 and the mold lubricant applicator 9 is positioned, the other unit simply moves out of the way, thus facilitating a smooth operation.

With respect to the mold lubricant applicator 9, the height of both of the discharge pipes 35*a* and 35*b* is adjustable while the lateral position of the discharge pipe 35*b* is adjustable. This makes it possible to apply mold lubricant to two different-sized casting molds simultaneously, thus saving more time.

Further, the height of the V-shape path can easily be adjusted by changing the degree by which the pivotal roller conveyor 13 is raised, thus facilitating continuous casting and drawing even when different-sized casting molds are used in the centrifugal casting unit 3.

Regarding the drawing unit 15, the oval board 15*e* is brought into contact with and engages the inner surface of a casting to be drawn out. Since the engaging inner surface of a casting and the portion thereof extending parallel to the axis of the casting form a tangent of the oval board 15*e*, damage that may be caused to the inner surface is minimized.

In addition, the oval board 15*e* of the present embodiment has only to be inserted into the casting W with the end linked to the wire 15*c* being inserted first as shown in FIG. 4B. The oval board 15*e* can be simply inserted into the casting W without paying much attention to the precise positioning of the oval board 15*e*. Then, the wire 15*c* is wound up to automatically make the oval board 15*e* engage the inner surface of the casting W and draw the casting W from the mold. On the other hand, the prior-art engaging board 109 must be inserted in the casting 103 while maintaining the major axis of the board 109 inclined. This means that the operator cannot simply place the engaging board 109, but must be careful in positioning the engaging board 109 in the casting 103. Then, after the engaging board 109 is manually erected so that the peak edges of the engaging board 109 are pressed onto and engaged with the inner surface of the casting 103, the casting 103 is drawn from the mold 101. This prior-art technique is more troublesome and time consuming.

This invention has been described above with reference to the preferred embodiments as shown in the drawings. Modifications and alterations may become apparent to one skilled in the art upon reading and understanding the specification. Despite the use of the embodiment for illustration purposes, the invention is intended to include all such modifications and alterations within the scope and spirit of the appended claims.

In this spirit, the elongated material carrier of the present invention may be applied to other apparatus than casting systems. In certain applications, the elongated material carrier may not have to move laterally. For example, in an apparatus where a bar being fed in the axial direction is continuously cut off at a predetermined length, cut bars discharged from a cutter can be conveyed one after another in the axial direction and then in the lateral direction. In this way, the cut bars can be continuously carried away from the conveyor, thus making it unnecessary to provide a lateral moving unit for laterally moving the conveyor.

If there are more than two elongated material discharging sources, the whole carrier does not have to move laterally as in the embodiment. It will suffice if means for laterally moving the fixed roller conveyor and the pivotal roller conveyor is provided. For instance, with such a system, once an elongated material has been discharged from the discharge source onto the two conveyers, the conveyors can be laterally moved to the means for laterally moving elongated materials where the pivotal carriers are lowered and the thrust arms are raised to dump the elongated material. Then, the conveyors can be brought back to the other discharge source to continue the operation.

Furthermore, a belt conveyor may be used as the means for moving elongated materials laterally. The thrust arms may not have to be integrally provided with the pivotal roller conveyor, that is, they may be separately provided and independently operated from the pivotal roller conveyor. Furthermore, the thrust arms may perform the thrust action by lateral movement rather than pivotal movement as in the embodiment. Other variations may also be possible.

As is touched upon in the embodiment section, the thrust arms 25 may also be dispensed with even though such thrust means is preferably provided for surely passing discharged materials on to the lateral ramps 17.

As has been explained above, the elongated material carrier of the present invention can continuously carry away elongated materials by laterally moving the elongated materials received by the roller conveyors without using a crane or the like, thus drastically reducing waiting time and the number of manufacturing steps.

According to the centrifugal casting system, manufactured castings can be drawn one after another from a plurality of casting molds in a continuous manner without interruptions caused by slinging and shifting the castings with a crane or the like. This enables a very efficient operation of a centrifugal casting system.

Also, the above centrifugal casting system can surely shift castings to the lateral conveying lane.

The centrifugal casting system can shift castings to the lateral conveying lane in a timely and smooth manner.

The centrifugal casting system can continuously carry out application of mold lubricant and draw/moving of castings without one operation disrupting the other.

According to the centrifugal casting system, the casting carrier and the mold lubricant can move together as one. Therefore, if one is positioned, the other moves out of the way, facilitating the whole operation.

In addition to the above advantages and effects, the centrifugal casting system offers the advantage of minimizing the damage that may be caused to the inner surface of castings.

What is claimed is:

1. A centrifugal casting system comprising a centrifugal casting unit having a single casting mold and a casting carrier provided in a position to draw a casting from the centrifugal casting unit, wherein said casting carrier comprises:

a fixed roller conveyor arranged in the direction in which castings are drawn and laterally tilted at a predetermined oblique angle to the horizontal;

a pivotal roller conveyor provided in the direction in which castings are drawn capable of pivoting between a first and second positions for forming in the first position a V-shape path together with the fixed roller conveyor in the direction in which castings are drawn and opening the V-shape path by pivoting downward about lower ends of the rollers to the second position;

drawing means for drawing castings through the V-shape path;

a lateral conveying lane for conveying castings in the direction lateral to the V-shape path; and stock means, provided at the far end of the lateral conveying lane, for stocking castings; and pivoting means for pivoting the pivotal roller conveyor between the first and second positions.

2. A centrifugal casting system of claim 1, wherein the centrifugal casting unit comprises no less than two casting molds provided side by side, further comprising:

carrier moving means for moving the casting carrier in the direction relatively lateral to the centrifugal casting unit.

3. A centrifugal casting system of claim 1, wherein the centrifugal casting unit comprises no less than two casting molds provided side by side, further comprising:

a lateral moving unit for laterally moving at least the fixed roller conveyor and the pivotal roller conveyor.

4. A centrifugal casting system of claim 1, wherein said pivoting means further comprises thrust means for thrusting out castings in the V-shape path by laterally moving between rollers of the fixed roller conveyor when the pivoting means opens the V-shape path by pivoting the pivotal roller conveyor to the second position.

5. A centrifugal casting system of claim 4, wherein said thrust means comprises thrust arms which pivot together with the pivotal roller conveyor whereby said thrust arms are pivoted by the pivoting means to thrust castings when the pivotal roller conveyor is pivoted to the second position.

6. A centrifugal casting system of claim 1, further comprising:

a mold lubricant applicator provided side by side with said casting carrier; and applicator moving means for moving the mold lubricant applicator in the direction relatively lateral to the centrifugal casting unit, wherein the mold lubricant applicator comprises:

a mold lubricant tank; and at least one means for discharging mold lubricant, the mold lubricant tank and the means for discharging mold lubricant being capable of moving in the axial direction of the centrifugal casting unit.

7. A centrifugal casting system of claim 6, wherein the mold lubricant applicator is connected to the casting carrier so that the mold lubricant applicator and the casting carrier move together in the lateral direction.

8. A centrifugal casting system of claim 1 wherein the drawing means comprises:

an oval board whose major axis is longer than the inner diameter of a casting;

a wire connected to the oval board at a point close to one end of the major axis;

a winch for winding up the wire, whereby a casting is drawn by placing the oval board inside of the casting and driving the winch to wind up the wire.

* * * * *